United States Patent [19]

Davis

[11] 4,003,769

[45] Jan. 18, 1977

[54] METHOD OF MAKING NON-RETENTIVE Al-Ni-Co-Fe ALLOY

[75] Inventor: Albert Roy Davis, Green Cove Springs, Fla.

[73] Assignee: BioMagnetics International, Inc., Jacksonville, Fla.

[22] Filed: Oct. 11, 1974

[21] Appl. No.: 514,311

[52] U.S. Cl. ..... 148/121; 148/31.55

[51] Int. Cl.[2] ..... H01F 1/00

[58] Field of Search ..... 148/31.55, 121, 120, 148/122, 100, 101, 102, 112; 75/124

[56] References Cited

UNITED STATES PATENTS

| | | | |
|---|---|---|---|
| 1,752,490 | 4/1930 | Karcher | 148/112 |
| 1,968,569 | 7/1934 | Ruder | 148/102 |
| 2,002,696 | 5/1935 | Kelsall | 148/31.55 |
| 2,027,994 | 1/1936 | Mishima | 75/124 |
| 2,980,563 | 4/1961 | Pavlovic et al. | 148/121 |
| 3,574,003 | 4/1971 | Nara et al. | 148/121 |
| 3,783,041 | 1/1974 | Tokushima | 148/121 |

OTHER PUBLICATIONS

Lyman, et al. (ed) Metals Handbook, vol. 2, (Heat--Treating), Metals Park, Ohio (ASM) 1964 p. 16.

Duff, A, et al.; Physics, Philadelphia, 1947 pp. 260–262.

Bozorth, R; Ferromagnetism, New York, 1951 pp. 6, 386, 387.

*Primary Examiner*—Walter R. Satterfield

*Attorney, Agent, or Firm*—Stuart J. Friedman

[57] ABSTRACT

A method for converting a high magnetic retentivity, high magnetic conductivity aluminium, nickel, cobalt and iron alloy to a substantially magnetically non-retentive alloy comprises heating the alloy to a temperature in the range 1400° – 1500° F. for about 30 minutes and quenching the heated alloy in a room temperature liquid coolant.

5 Claims, No Drawings

METHOD OF MAKING NON-RETENTIVE AL-NI-CO-FE ALLOY

The present invention relates to high magnetic conductivity, low magnetic retentivity alloys and, more particularly, to methods of making the same.

Electro-magnetic apparatus, such as transformers, relays, electric motors, tape recording heads and the like utilize relatively easily magnetizable, i.e., highly magnetically permeable, alloys as essential structural materials. Generally, the apparatus is formed of steel alloys because they can be readily worked into many useful forms and are relatively inexpensive. They are also known to have superior magnetic permeability, i.e., an ability to conduct magnetism many times better than other common materials. Most importantly, steel alloys are magnetically "soft", i.e., they have a very low value of magnetic memory or retentivity. In other words, once the influence of any magnetizing force is removed, the magnetically "soft" steel retains only a relatively small residual amount of magnetism.

However, notwithstanding their relatively low magnetic retentivity, it has been found that conventional "soft" steel alloys still retain a measurably significant residual magnetization after the magnetizing force is removed. This residual magnetism creates a number of problems, for example interfering with flux transfer in a transformer and requiring periodic de-magnetization of the heads of present-day tape recorders, reel-to-reel and cassette recorders. The residual magnetism presents a particular problem in recording instruments since it affects and alters the true recorded tones. To avoid, at least in part, this adverse effect, the heads must be periodically and properly demagnetized, a costly and time-consuming procedure.

Another problem with "soft" magnetic alloys is that they possess insufficient strength, wear resistance and hardness, and generally cannot be heat treated or work hardened to improve their physical metallurgical properties without adversely affecting their magnetic properties. There do exist, however, a class of ferromagnetic alloys which are usually more highly alloyed than "soft" magnetic alloys and which exhibit the requisite physical metallurgical properties. Unfortunately, this class of alloys, although readily permeable to applied magnetization, are magnetically "hard", i.e., they have a relatively good magnetic memory and retain a very large proportion of the magnetism applied thereto. When magnetically "hard" steel or Alnico, for example, is exposed to magnetism, even if only for a short time, it will remember the exposure by retaining a relatively large proportion of the original magnetism, and will itself act as a magnet. Thus, while these magnetically "hard" alloys exhibit good physical properties and some good magnetic properties, particularly good magnetic permeability or conductivity, they have heretofore been ignored for use in electro-magnetic apparatus such as transformers and magnetic recording devices due to their very high magnetic retentivity.

It is therefore an object of this invention to provide a magnetically "hard" alloy which is characterized by extremely low magnetic retentivity.

It is another object of the invention to provide a method for converting a high magnetic retentivity alloy to a substantially magnetic nonretentive alloy.

It is still another object of the invention to provide a ferromagnetic aluminum-nickel-cobalt-iron alloy exhibiting high magnetic permeability or conductivity and low magnetic retentivity and a process for making such an alloy from conventional high magnetic retentivity aluminum-nickel-cobalt-iron alloys.

Other objects and advantages will become apparent from the following description and appended claims.

It is well known that Alnico magnetic alloys, containing chiefly aluminum, nickel, cobalt and iron, have outstanding properties as a permanent magnet and are physically strong and wear resistant while at the same time being highly permeable to applied magnetization. Indeed, it is the inherent high magnetic retentivity of such an alloy which permits it to act as a permanent magnet and which disqualify it as a suitable alloy for use in electro-magnetic apparatus in which magnetic retentivity must be avoided. According to the present invention, these high retentivity aluminum-nickel-cobalt-iron alloys can be converted to alloys having magnetic retentivity so low that the retentivity is virtually negligible, i.e., about 1/1000 gauss or less retained magnetic energy in applied fields up to 1500 gauss over extended periods of time. In fact, the magnetic retentivity of the resulting alloys is appreciably lower than the conventionally acknowledged low retentivity of typical "soft" magnetic alloys. As a consequence, the present invention provides an alloy which exhibits the advantageous physical properties of the "hard" magnetic alloys and the beneficial magnetic properties of the "soft" magnetic alloys, especially a high resistance to retaining applied magnetism.

Magnetic materials of the Alnico type are well known permanent magnets exhibiting strong magnetic properties similar in all directions. They are basically alloys of aluminum-nickel-cobalt-iron but can and do contain, in relatively limited quantities, other metals or alloys, such as copper, brass or bronze. Typical Alnico alloy compositions among the many reported in the literature include:

12% Al, 20% Ni, 5% Co, balance Fe
10% Al, 17% Ni, 12.5% Co., 6% Cu, balance Fe
8% Al, 14% Ni, 24% Co, 3% Cu, balance Fe
12% Al, 28% Ni, 5% Co, balance Fe Conventional Alnico alloys may be cast or sintered, exhibit good magnetic conductivity and typically high magnetic retentivity. They are characterized by their ability to be heat treated or work hardened to improve, adjust or alter their strength, high wear resistance and hardness. Thus they are extremely flexible in application and, at least from a physical metallurgical standpoint, were it not for their high magnetic retentivity, would make suitable electro-mechanical equipment components such as transformer cores, relay coils, wires or windings, and components of magnetic recording equipment.

To convert the conventional Alnico alloys to a form magnetically acceptable in terms of magnetic retentivity, i.e., to destroy the high retentivity characteristics of such metals, and to provide a new alloy capable of being formed or shaped, and exhibiting high magnetic permeability or conductivity together with substantially no magnetic retentivity is the primary object of this invention. In accordance therewith, this is accomplished by heating the alloy to a temperature in the range of about 1400° – 1500° F. for a period of from about 24 to 36 minutes, the specific heating time depending upon various considerations, but primarily upon the dimensions and/or mass of the alloy, and thereafter quenching the thus heated alloy, preferably in room temperature water (e.g. 68° F.) or alternatively in a coolant chemical bath. Generally, quenching should be completed in about 20 minutes.

For best possible results, it is desirable that the Alnico alloy be heated and quenched according to the present process in bars, sheets, rods or other shapes in which at least one dimension does not exceed one-half inch. In this manner, proper and complete heat treating can be accomplished within the specified time period at temperatures of about 1400° F. Larger alloy castings generally require heat treatment for the specified time period at about 1500° F. to achieve comparable reduction or elimination of magnetic retentivity.

This heat treating-quench sequence is believed to be effective to convert a high magnetic retentivity Alnico alloy to a low or substantially no retentivity alloy without adversely affecting the magnetic conductivity of the alloy because the rapid quench is believed to entrap iron oxides formed during the heating step. It has been found that the desired low or no retentivity alloy is not obtained if the heated alloy is allowed to cool slowly to room temperature over an extended period of, for example, several hours.

The Alnico alloys may be formed, ground or otherwise shaped to their ultimate desired configuration either before or after the herein described heating-quenching sequence. One convenient and desirable method is to cast the desired ultimate configurations from the molten Alnico alloy, i.e. in the course or formulation of the alloy itself, allowing the cast alloy to cool and then performing the heating-quenching sequence on the shaped, cooled alloy to produce directly the low magnetic retentivity final product. Alternatively, the ultimate desired configuration can be shaped following conversion of the magnetic retentivity properties of the alloy by heating-quenching as herein described. It will be appreciated, however, that following the alternate procedure requires an additional step in that formulating the Alnico alloy and shaping are performed separately instead of being combined into a single step.

The following examples exemplify, but do not limit, the process and product of the present invention.

EXAMPLE I

Alnico alloys having each of the following compositions were prepared and cast into a number of samples having various shapes. At least one dimension of each sample being less than about one-half inch.

12% Al — 20% Ni — 5% Co — 63% Fe

10% Al — 17% Ni — 12.5% Co — 6% Cu, 54.5% Fe

8% Al — 14% Ni — 24% Co — 3% Cu — 49% Fe

Each of the alloy samples was heated in a furnace to about 1450° F. for about 30 minutes after which the samples were promptly removed from the furnace and immersed in a room temperature water bath for about 20 minutes.

EXAMPLE II

A DC magnetizing energy of about 1500 gauss was applied to the samples from Example I for periods of time up to several months. At periodic intervals the retained magnetism in a sample was measured to determine the magnetic retentivity of the sample. Over the test period, every sample tested exhibited a measured retentivity of less than about 1/1000 gauss irrespective of the period of application of the magnetizing force.

At the same time, a like magnetic force was applied to similar samples of conventional "soft" magnetic materials, such as cold roll steel and the magnetic retentivity of these samples was measured as a function of time in the same manner as with the Alnico samples. It was found that the retentivity of the cold roll steel was in all cases greater than that of the Alnico samples treated in accordance with the present process. The retained magnetism of the cold roll steel samples varied depending on the period of application of the magnetizing force from about 1 gauss retained after 24 hours of the applied force up to about 2 gauss retained after several months, approaching one year.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

What is claimed as new is as follows:

1. A method for converting a high magnetic retentivity, high magnetic conductivity aluminum-nickel-cobalt-iron alloy consisting essentially of 8–12% aluminum, 14–28% nickel, 5–24% cobalt, balance iron, to a substantially magnetically non-retentive alloy consisting essentially of the steps of:

a. heating said alloy to a temperature in the range 1400°–1500° F for a period of from 24 to 36 minutes, said heating temperatures and times selected to yield a product having a magnetic retentivity of about 1/1000 gauss or less in applied fields of up to 1500 gauss; and b. rapidly quenching said heated alloy.

2. A method, as claimed in claim 1, wherein said quenching is accomplished within about 20 minutes.

3. A method, as claimed in claim 1, wherein said quenching is accomplished in a room temperature liquid.

4. A method, as claimed in claim 1, wherein said alloy is heated for about 30 minutes.

5. A method, as claimed in claim 1, wherein said alloy includes at least one dimension not exceeding one-half inch and said alloy is heated to about 1400° F.

* * * * *